United States Patent [19]

Hess

[11] Patent Number: 4,976,568

[45] Date of Patent: Dec. 11, 1990

[54] DEVICE FOR RAISING LEVEL OF MANHOLE COVER

[75] Inventor: Mathias C. Hess, Brights Grove, Canada

[73] Assignee: The Hopper Foundry (1977) Limited, Ontario, Canada

[21] Appl. No.: 503,093

[22] Filed: Apr. 2, 1990

Related U.S. Application Data

[63] Continuation of Ser. No. 260,299, Oct. 20, 1988, abandoned.

[51] Int. Cl.[5] ..... E02D 29/14

[52] U.S. Cl. ..... 404/26; 404/25; 52/20

[58] Field of Search ..... 404/24–26; 52/19–21

[56] References Cited

U.S. PATENT DOCUMENTS

| | | | |
|---|---|---|---|
| 2,431,082 | 11/1947 | Sayles | 404/26 |
| 2,593,918 | 4/1952 | Redman | 404/26 |
| 4,038,789 | 8/1977 | Axgärde | 52/20 |
| 4,187,647 | 2/1980 | Hall | 52/20 |

FOREIGN PATENT DOCUMENTS

| | | | |
|---|---|---|---|
| 1089275 | 11/1980 | Canada . | |
| 1135103 | 11/1982 | Canada . | |
| 225099 | 4/1988 | Sweden | 404/26 |
| 1249860 | 10/1971 | United Kingdom | 404/26 |

OTHER PUBLICATIONS

The 3 Minute Lift Ring by the Hopper Foundry (1987) Limited.

*Primary Examiner*—Bruce M. Kisliuk
*Assistant Examiner*—Gay Ann Spahn
*Attorney, Agent, or Firm*—Fetherstonhaugh & Co.

[57] ABSTRACT

This invention relates to a spacer for a manhole cover for use in a manhole frame comprising a ring having a mounting surface adapted to sit on the top of a manhole cover frame. The ring has a seating surface for, in use, the seating of a manhole cover thereon. The seating surface is spaced radially inwardly of the mounting surface. The ring has a downwardly extending portion below the seating surface. The downwardly extending portion has a lesser outside diameter than the portion above said seating surface to enter into the manhole cover frame in use.

1 Claim, 3 Drawing Sheets

DEVICE FOR RAISING LEVEL OF MANHOLE COVER

Figure 1:
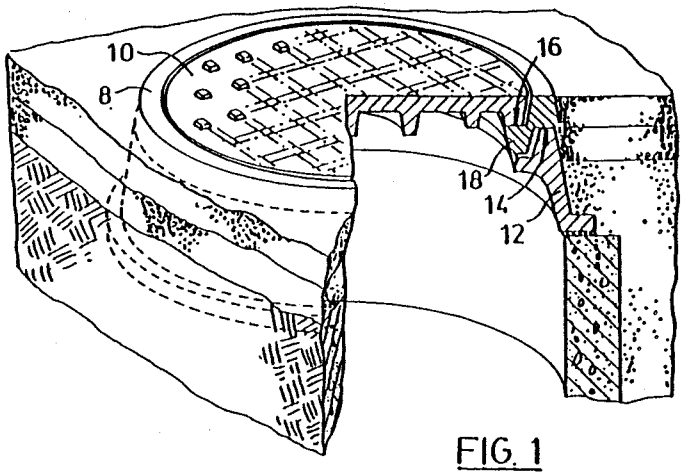

This application is a continuation, of application Ser. No. 07/260,299, filed Oct. 20, 1988 now abandoned.

This invention relates to a device for raising manhole covers when asphalt is being layered on a road.

During the resurfacing of roads, new asphalt is laid. This raises the level of the road. Consequently, the manhole covers on the road for the sewer system must also be raised.

It has been one practice to reset the manhole frame in its masonry setting. The manhole frame is loosened, the masonry setting is built up, and then the frame is reset in the built-up position. This process is slow and expensive. It often takes two workers a half day to raise a single manhole frame.

Relatively complex manhole frames with provision for adjusting the height of the seat for the manhole cover have been proposed. These solutions are relatively complex and expensive.

Solutions involving the use of a spacer ring made of cast or ductile iron to raise the seating position of the manhole in the frame also have been used but they have involved the use of parts made of steel that are welded to a cast iron spacer ring. The spacer ring sits in the cover frame and an upwardly extending steel flange is welded to the spacer ring to contain the overlying manhole cover.

The problem with this solution is that the steel corrodes and rusts due to the action of salt and water and the unit is often unserviceable after two years. The installation of the unit is also relatively time consuming.

This invention employs a simple cast iron or equivalent material spacer ring to raise the cover but avoids the use of welded steel components. The spacer ring in the case of this invention sits directly on the top of the manhole cover frame and can be cast in one piece from cast iron or the like. It is easy to install in the manhole frame and is not as subject to corrosion as a structure that involves steel.

According to one aspect of the present invention, there is provided an as-cast manhole assembly that comprises a manhole cover frame, a manhole cover and a spacer ring seated on the manhole cover frame and supporting the manhole cover in elevated relation thereon, an improved as-cast cast iron spacer ring having an external recess formed with a first seating surface which extends laterally outwardly from the perimeter of the spacer ring and is arranged to sit on the top surface of the manhole cover frame in use, said spacer ring having an internal recess formed with a second seating surface, said internal recess being proportioned to accommodate the manhole cover and support it at a level below the level of said first seating surface, the outer edge of said second seating surface being spaced inwardly of the inner edge of said first seating surface to support a manhole cover inwardly of the internal recess of the manhole cover frame, a spacer ring securing structure on said spacer ring depending downwardly of said seating surface to lie in spaced relation to the sidewall of the manhole cover frame and define a space of annular cross section between the spacer ring securing the structure and the manhole cover frame, a mechanical leverage spacer ring securing means carried by said spacer ring securing structure and operable in the said space of annular cross section between the securing structure and the side wall of the manhole cover frame for rigidifying the spacer ring with respect to the side wall of the manhole cover frame.

Figure 2:
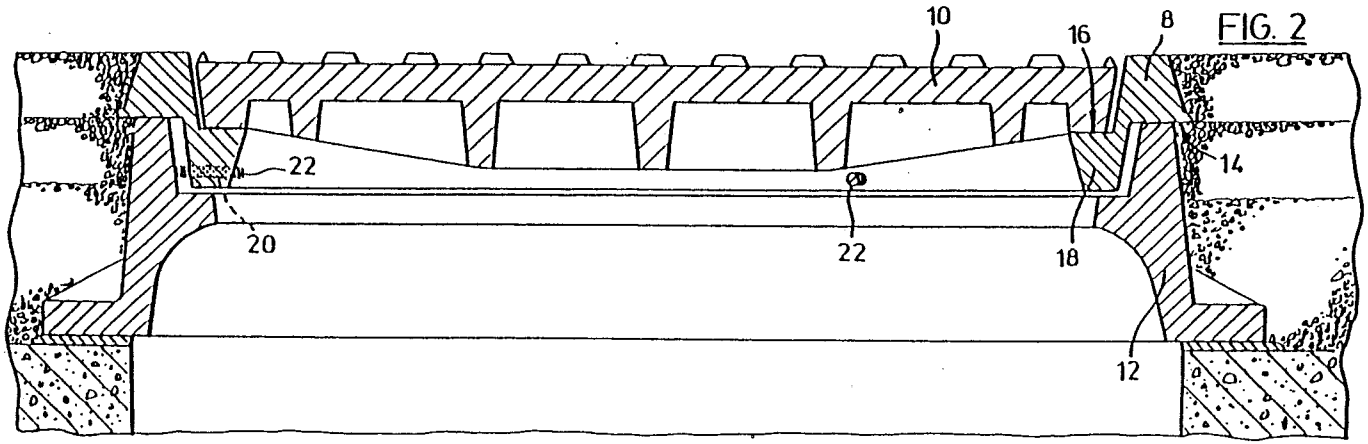
Figure 3:
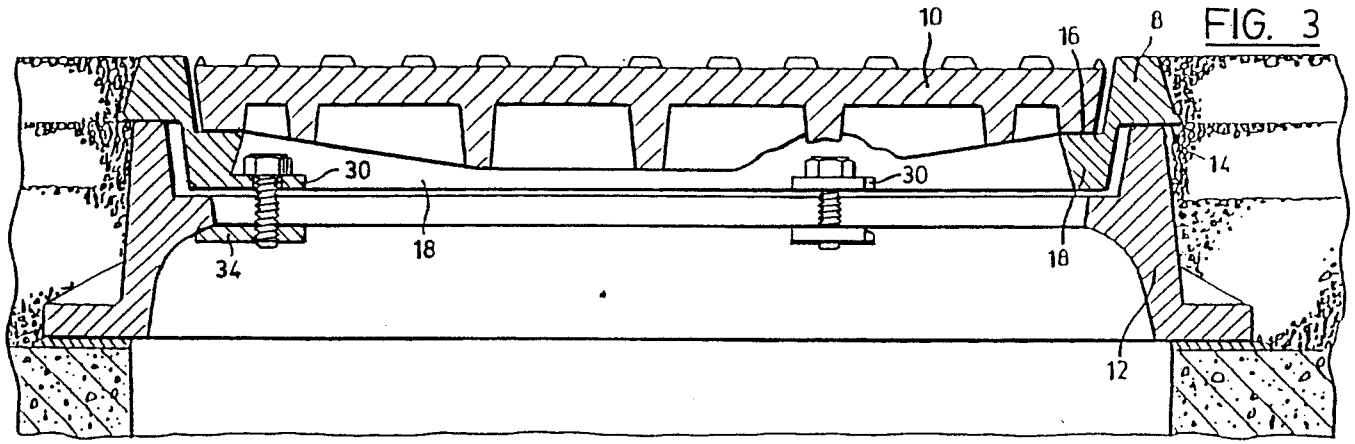
Figure 5:
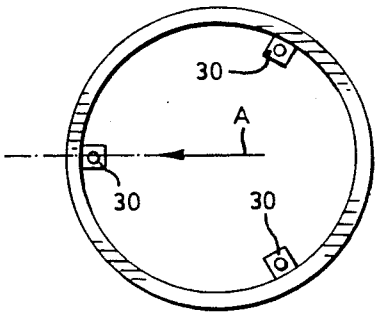
Figure 6:
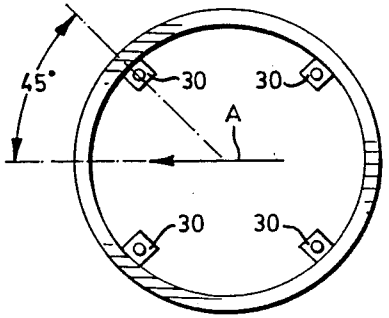
Figure 4:
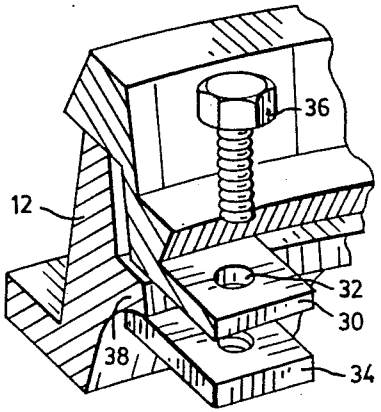

The invention will be more readily understood after the following more detailed description given in conjunction with the drawings in which;

FIG. 1 is a perspective view of a manhole cover;

FIG. 2 is a cross-section of a manhole cover mounted on a manhole frame a spacer according to the invention in place, FIG. 3 is a sectional view similar to FIG. 2 showing a further embodiment the present invention, FIG. 4 is an enlarged detail of the clamping mechanism of FIG. 4, FIG. 5 is a plan view showing the position of the mounting lugs of a spacer ring of the type having three lugs, with respect to the direction of vehicular traffic on the roadway in which the manhole FIG. 6 is a plan view showing the position of the mounting lugs of a spacer ring of the type having four lugs, with respect to the direction of vehicular traffic on the roadway in which the manhole is located.

Referring to the drawings, the spacer is referenced generally by numeral 8, the manhole cover the numeral 10 and the manhole frame by the numeral 12.

The spacer has a mounting surface 14 and a seating surface 16.

The mounting surface 14 sits on the upper surface 15 of a manhole frame 12.

The seating surface 16 provides a seat for the manhole cover 10.

The seating surface 16 is spaced radially inwardly of the mounting surface 14. The radial spacing permits the casting of the spacer in one piece. The inner portion 18 of the spacer 8 depends below the seating surface 16 as a ring and there are circumferentially spaced apart set screws 22 which extend through the lower portion 18 to rigidly secure the spacer 8 with respect to the manhole cover 10 as illustrated. It will be apparent that the complete spacer 8 can be made from a single casting and this is the preferable construction.

Manhole frames are of varying diameter, but the simple securing means can be quickly adjusted by the installer to mount the device in varying diameters as required.

The outside diameter of the spacer 8 does not have to be varied to achieve a good fit. The inside diameters of manhole cover frames vary by about ¾ of an inch. This cover does not seat inside the frame so that one size of outside diameter fits all frames. The lower portion is rugged, simple and effective because of the novel shape and seating of the spacer ring 8.

In the embodiment shown, set screws 22 are provided. The set screws 22 extend through threaded holes 20 of the spacer 8 to engage against the manhole frame 12. The tightening of the set screws 22 ensures that the spacer 8 is secured against the manhole frame 12. The diameter of the spacer 8 does not have to be varied using this form of securing means. Because the lower portion 18 is lower than the mounting surface 14 of the spacer 8, the unit sits securely in the frame.

The installation of the spacer 8 to raise the manhole cover 10 can be efficiently accomplished by a work crew positioned a short time ahead of the asphalt-laying work crew as one continuous operation. There are very few steps involved. After the original manhole has been removed, the spacer 8 is placed in secure relationship to the manhole frame 12 by tightening the set screws 22 so that they engage firmly against the manhole frame 12. The manhole cover 10 may then be placed on the spacer 8 so that it sits on the seating surface 16 of the spacer.

There is no longer a requirement to uproot or raise the manhole frame nor is there a requirement to make the spacer 8 out of composite parts.

Although the spacer 8 herein illustrated is circular, some manhole frames and their respective manhole covers are rectangular. It will be apparent that this invention is equally applicable to raising rectangular manhole covers by using rectangular spacers made according to this invention and it is not intended that this invention should only be limited to spacers that are circular in shape.

The manhole cover 10 is a replacement manhole cover and is of a different size to the original manhole cover. It would be supplied with the spacer as a set. The cover cost is an item but the cost of the new cover is insignificant when compared to the savings of installation of this invention.

In a further embodiment of the present invention illustrated in FIGS. 3 and 4, the set screws 22 and threaded holes 20 are replaced by a clamping structure 40 which serves to clamp the spacer 8 to the manhole frame 12. In this embodiment, the spacer 8 is formed with a plurality of lugs 30 which project radially inwardly from the inner perimeter of the lower portion 18. Each of the lugs 30 is formed with a through passage 32. A threaded bolt 36 extends through the passage 32 and is threadedly mounted in a clamping plate 34. The clamping plate 34 has a sufficient length to extend to a position in which it underlies the flange 38 of the manhole frame 12.

By tightening the bolt 36 into the threaded passage of the clamping plate 34, the clamping plate 34 is drawn upwardly into engagement with the flange 38 and serves to clamp the spacer 8 with respect to the manhole frame 12 so that it is positively retained therein.

At least three clamping lugs 30 and their associated clamping bolts and clamping plates are provided at substantially uniformly spaced circumferential intervals.

As shown in FIG. 5, when a spacer ring having three lugs 30 is to be used on a road surface where vehicles will travel in the direction of the arrow A, one of the lugs 30 is arranged to assume a twelve o'clock position aligned with the direction of the arrow A. This again adds stability to the installation and reduces the likelihood of the clamping mechanisms working loose as a result of vibration.

In the embodiment illustrated in FIG. 6 of the drawings where four lugs 30 are provided, the lugs are preferably arranged to be located at about 45° from the twelve o'clock position with respect to the direction of the arrow A.

Other embodiments of the invention to the one illustrated within the scope of this invention will be apparent to those skilled in the art.

I claim:

1. A manhole assembly comprising:

(a) a manhole cover frame having, a manhole opening extending therethrough and a support flange extending around the perimeter of the manhole opening, a first manhole cover seat extending downwardly to the support flange, said seat being downwardly tapered and an upper face extending laterally outwardly from the seat, (b) a spacer ring having an upper portion and a lower portion, the lower portion having an external recess formed below the upper portion such that a lower face of the upper portion forms a first seating surface that rests on the upper face of the manhole cover frame, the lower portion tapering downwardly from said upper portion and being fitted in a free fitting relationship within said first manhole cover seat, and an internal recess extending downwardly within the upper portion and forming a second seat which is downwardly tapered and which has a manhole cover support face that extends laterally inwardly and is located below said first seating surface, (c) clamping means carried by the spacer ring and clamping the spacer ring to the support flange of the manhole cover, (d) a manhole cover having an outer side face that is downwardly tapered and a supporting edge of a predetermined thickness extending inwardly from said outer side face and having a lower face that extends inwardly from said outer side face, the manhole cover being fitting in a free fitting relationship within said second seat with said lower face resting on the manhole cover support face of the spacer ring such that the extent to which the manhole cover is raised above the first manhole cover seat is less than the predetermined thickness of the supporting edge of the manhole cover.

* * * * *